US005494450A

United States Patent [19]

Kirsch et al.

[11] Patent Number: 5,494,450

[45] Date of Patent: Feb. 27, 1996

[54] ELECTRICAL CONNECTOR WITH SHORT CIRCUITING FACILITY

[75] Inventors: Bernhard Kirsch, Lampertheim; Kai Sellien, Zwingenberg; Hans-Joachim Zander, Schifferstadt, all of Germany

[73] Assignee: The Whitaker Corporation, Wilmington, Del.

[21] Appl. No.: 213,328

[22] Filed: Mar. 15, 1994

[30] Foreign Application Priority Data

Mar. 19, 1993 [GB] United Kingdom ..... 9305758

[51] Int. Cl.[6] ..... H01R 29/00

[52] U.S. Cl. ..... 439/188; 439/724

[58] Field of Search ..... 439/512, 513, 439/721, 723, 724, 786, 787, 188

[56] References Cited

U.S. PATENT DOCUMENTS

| | | | |
|---|---|---|---|
| 3,431,536 | 3/1969 | Olson | 439/724 X |
| 3,597,726 | 8/1971 | Appleton | 439/724 OR |
| 5,041,017 | 8/1991 | Nakazato et al. | 439/513 X |
| 5,114,356 | 5/1992 | Taybl et al. | 439/724 X |

FOREIGN PATENT DOCUMENTS

| | | | |
|---|---|---|---|
| 2309138 | 9/1973 | Germany | 439/786 |
| 0606241B1 | 4/1995 | Germany . | |

*Primary Examiner*—Neil Abrams
*Assistant Examiner*—Daniel Wittels
*Attorney, Agent, or Firm*—Eric J. Groen; Mary K. Van Atten

[57] ABSTRACT

An electrical connector is comprised of an outer housing having a rack and pinion lever, where the outer housing can receive in sliding engagement an inner housing. The inner housing carries a plurality of receptacle contacts and a plurality of shunt contacts disposed above selected contacts. The shunt spring has a base wall including individual shunt contact springs having a projection which extends through a window of a central wall to make shunt contact with adjacent electrical terminals positioned therebeneath.

14 Claims, 5 Drawing Sheets

ELECTRICAL CONNECTOR WITH SHORT CIRCUITING FACILITY

BACKGROUND OF THE INVENTION

1. Field of the Invention

This invention relates to an electrical connector having a short circuiting facility and to a short circuiting spring therefore, the invention particularly, but not exclusively, concerning such a connector for use and protecting from accidental firing, an electrical detonator for inflating an automotive air bag.

2. Description of the Prior Art

In automotive air bag deployment systems, crash sensors disposed in the forward part of a motor vehicle are connected to the detonators of air bags before the front seats of the vehicle. Such a detonator may be connected to ignition voltage means by means of an electrical connector, the parts of which can be unmated to allow the air bag and/or the detonator thereof to be removed for replacement testing, and the like. In the unmated, or indeed in a partially unmated condition of the electrical connector, there is the risk of the detonator, which is necessarily very sensitive, being accidently actuated so that the air bag is accidently inflated. This may occur, for example as a result of leakage or other stray voltage, or accidently applied current, energizing the ignition current supply leads of the detonator for example, by electro magnetic induction.

For the avoidance of the risk described above, there is disclosed in GB 2455775, an electrical connector assembly comprising a receptacle part and a pin carrying part for mating with, the receptacle part comprising an insulating housing defining first and second space parallel through cavities each receiving a pin receptacle terminal therein and intermediate said cavities a short circuiting spring having a normal first position which a contact surfaces thereof engage against the terminals to provide a shorted electrical path therebetween. A displaced second position in which the contact surfaces are out of engagement with the pin terminals is also provided, where the pin carrying part comprises an insulating member which projects pins from mating with the receptacle terminals as the parts are being mated and a camming members for engaging the short circuiting spring to displace it from the second position when partially mated, the short circuiting spring resiling from its second position to its first position upon withdrawal of the camming member from the short circuiting spring.

SUMMARY OF THE INVENTION

In this known electrical connector assembly, the short circuiting spring which has been stamped and formed from a single piece of sheet metal stock, has a pair of wings projecting therefrom, the free ends of which engage the terminals of the first position of the short circuiting spring. The contact surfaces of the wings are necessarily sheared surfaces which are very narrow and unsuitable for selective plating with the corrosion resistant high electrically conductive material such as gold.

DETAILED DESCRIPTION OF THE PREFERRED EMBODIMENT

Figures 1, 2, 3:
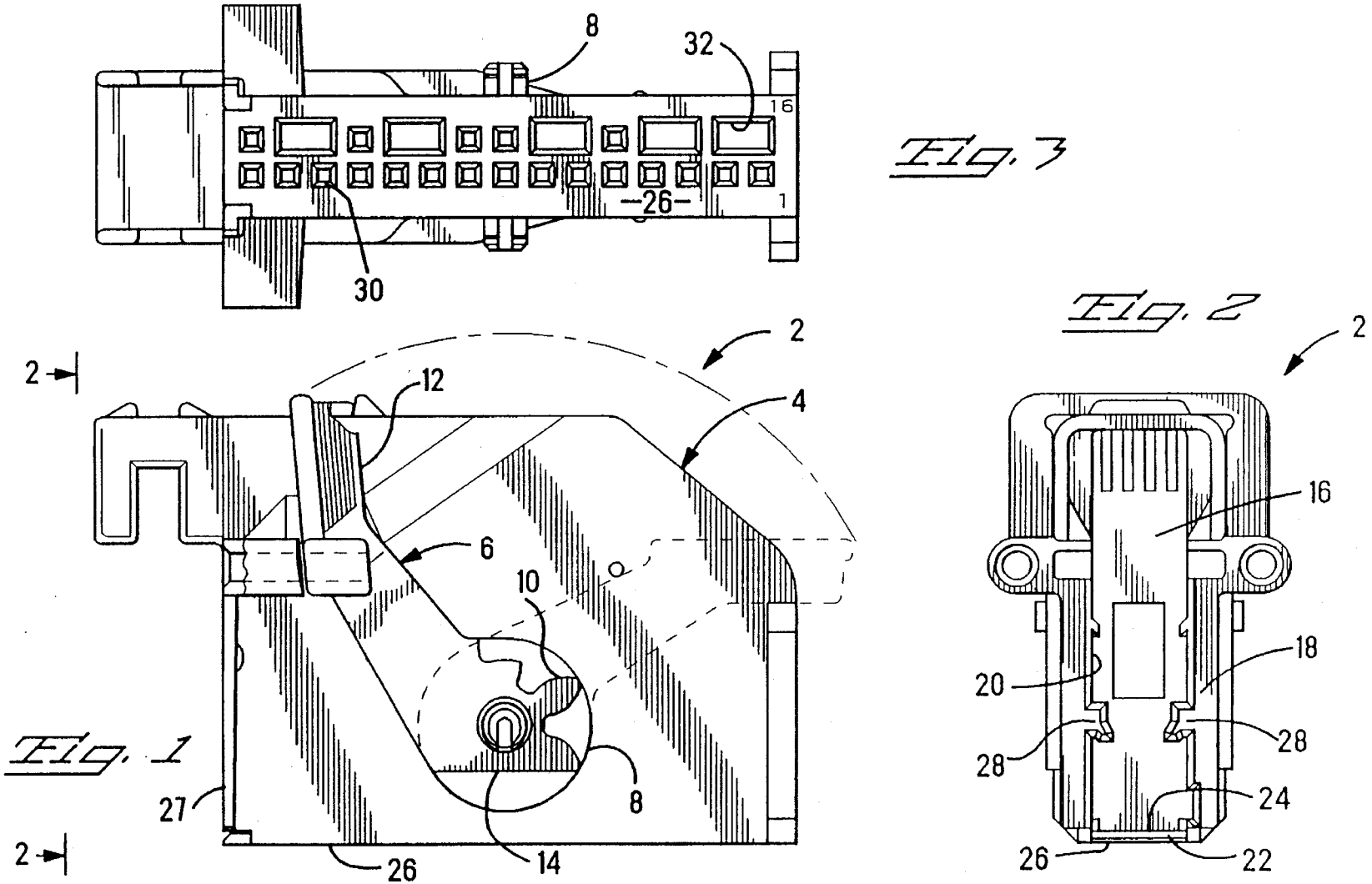
FIG. 1 is a side plan view of an outer housing of the present invention.
FIG. 2 is an end view in the direction of arrows 2 shown in FIG. 1.
FIG. 3 is a front plan view of the front mating face of the housing shown in FIG. 1.

With reference first to FIG. 1, an outer insulating housing is shown generally at 2 comprising a housing portion 4 and a locking pinion member 6 of the type shown in German Utility Model number G8714016. The locking pinion member 6 pivots about a pin 8 and has rachet teeth 10 and a lever arm 12. The locking pinion member 6 is pivotable to the position shown in phantom in FIG. 1, whereby a guiding edge 14 is now disposed in a vertical plane for guiding the housing 2 into its associated header assembly (not shown). Rotation of the lever arm 12 back to the position shown in FIG. 1 moves the housing downwardly and in to mating engagement with the tab header.

As shown in FIG. 2, the housing 2 is shown including a cavity 16 which opens towards the left hand end of the housing as viewed in FIG. 1, defined by side walls 18 having inner surfaces 20. The housing also includes a lower wall portion 22 defining an inner surface 24 and a front mating surface 26. The side walls 18 include longitudinally extending guide rails 28 along the length thereof, as will be explained in greater detail herein. As viewed in FIG. 3, the front face 26 is shown as including a plurality of pin receiving openings at 30 extending in a longitudinally extending row, as well as a plurality of rectangular shaped openings 32, where each opening 32 spans the distance of two openings 30, as will be described further herein.

Figure 5:
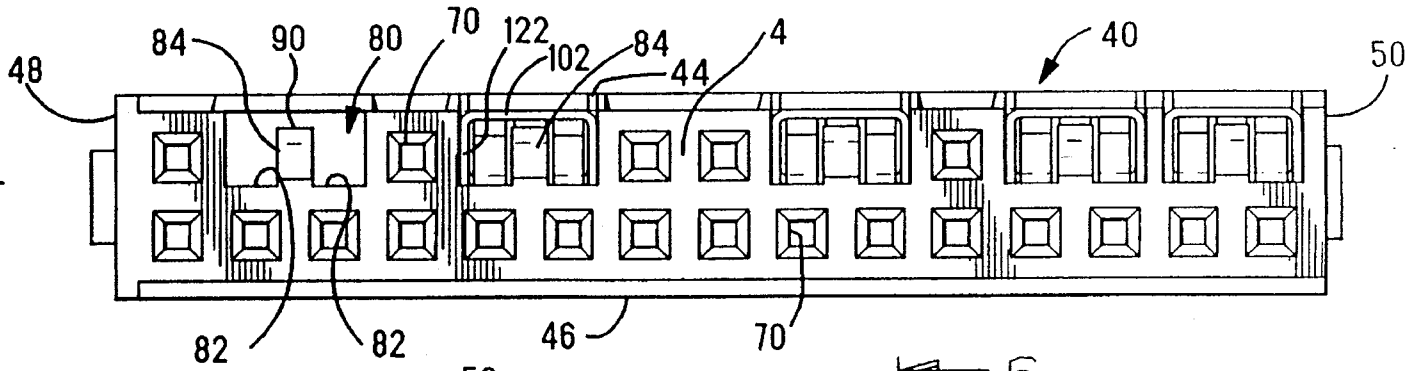
FIG. 5 is a front plan view of the mating face of the housing shown in FIG. 4.
Figure 4:
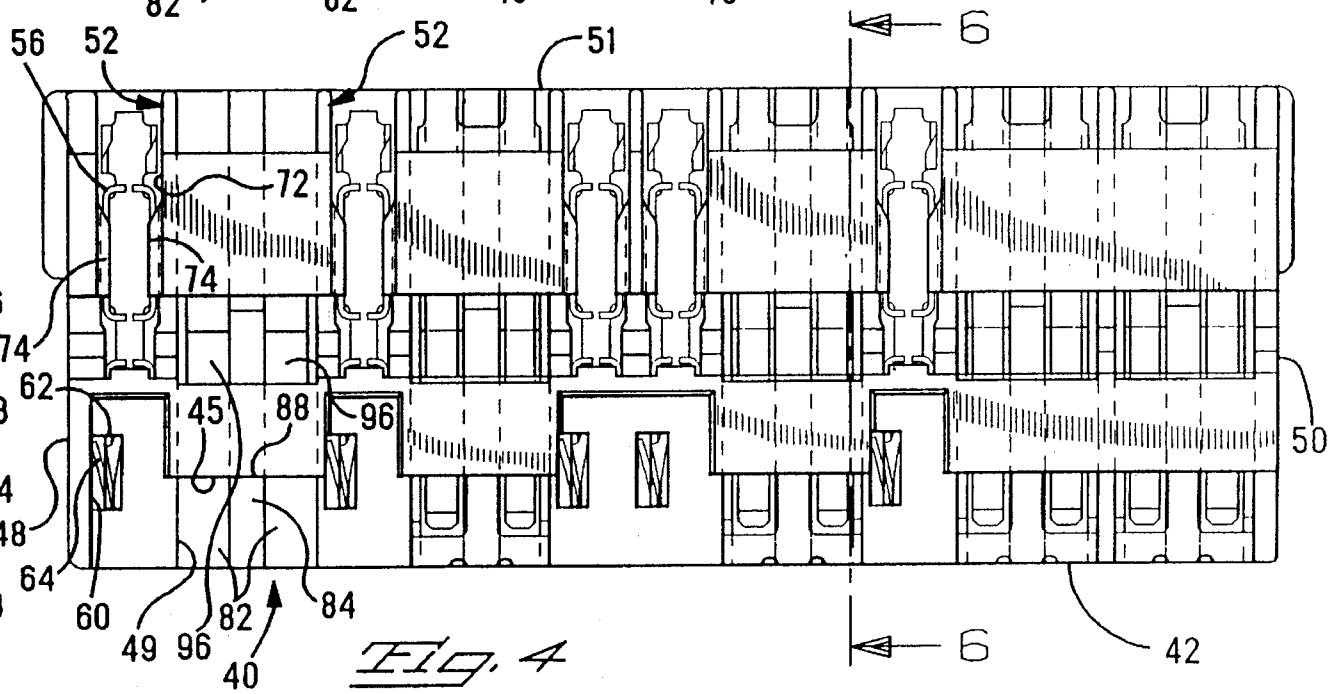
FIG. 4 is a side plan view of an inner housing which is insertable into the outer housing shown in FIG. 1.
Figure 6:
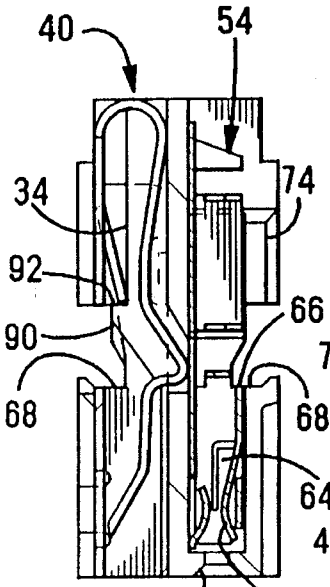
FIG. 6 is a cross sectional view taken through lines 6—6 of FIG. 4.

With reference now to FIGS. 4 through 6, an inner housing is shown at 40 comprising a front mating face at 42, a top surface 44, a lower surface 36, side surfaces 48 and 50, and an end surface 51. As shown best in FIG. 4, the housing 40 includes a plurality of terminal receiving passageways 52 for receiving conventional style terminals 54 where the terminals include an insulation displacement contact at 56 (FIG. 4) and cantilever spring beam contacts 58 (FIG. 6). The housing is formed with windows at 60 which forms a transverse shoulder at 62 to cooperate with the locking lance 64 of the electrical terminal 54. A rear edge 66 of a terminal is positioned adjacent to an opening 68 in the housing to provide a secondary locking mechanism as will be described in greater detail herein. The housing 40 further includes a plurality of pin receiving openings at 70 as shown in FIGS. 5 and 6, which cooperate with the pin receiving openings 30 in the outer housing, for example when comparing FIGS. 3 and 5. It should also be noted that, in a similar manner to the outer housing 4, as shown in FIG. 3, the lower row includes only passageways 52, to accommodate an entire row of terminals 54. Finally the housing 40, as best shown in FIG. 4 includes openings at 72 which allow access for mass termination of insulated conductors into the insulation displacement slot 56 through the opening 72. Integral shoulders 74 overlie the insulation displacement member 56 for retention purposes, yet allow mass termination of the wire.

With respect still to FIGS. 4 through 6, the housing 40 also includes a plurality of passageways 80, and in the specific embodiment five such passageways being shown, which are profiled to receive a shunt spring to be described more fully herein. As shown in FIG. 5, the passageway 80 is somewhat U-shaped including side-by-side channels 82 having an intermediate wall 84 separating the two channels 82 into discrete passageways. As shown best in FIGS. 4 and 6, a second longitudinal opening is provided at 88 which extends the length of the housing 40 (FIG. 4) forming an upper surface 90 of the wall 84. A locking shoulder 92 is positioned behind the top surface 90 and thereafter steps down to a recessed surface 94.

Figure 10:
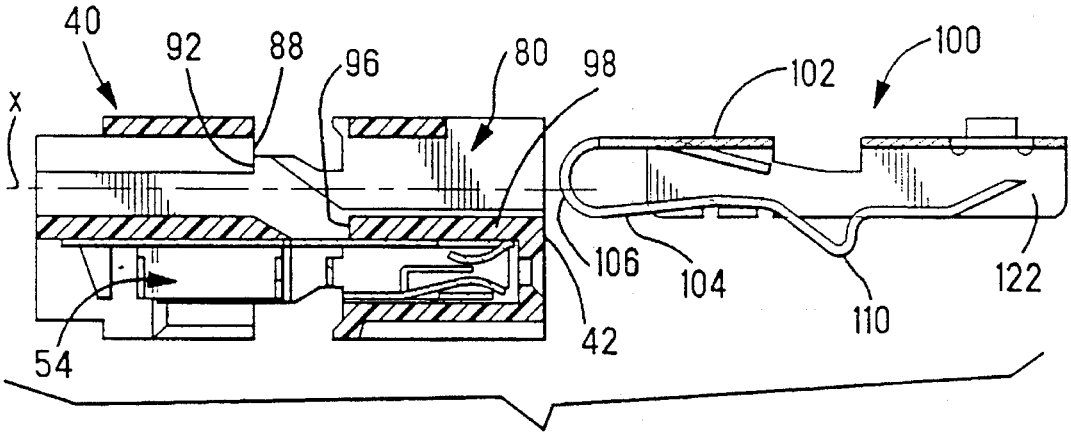
FIGS. 10 through 15 are cross sectional views similar to that of FIG. 6 showing step by step insertion of the shunt spring.

With respect now to FIG. 10, at the same axial position as the longitudinal opening 88 along the center line X of the passageway 80, a window is formed at 96 through the central wall 98 which separates the two rows of terminals. The window 96 thus communicates with one of the terminal receiving passageways 52 directly below the window. As best shown in FIG. 4, the windows 96 are positioned within the separate channels 82 separated by the wall 84 and therefore the windows 96 provide access to two adjacent terminal receiving passageways 52 in the lower row of terminal passageways.

Figure 9:
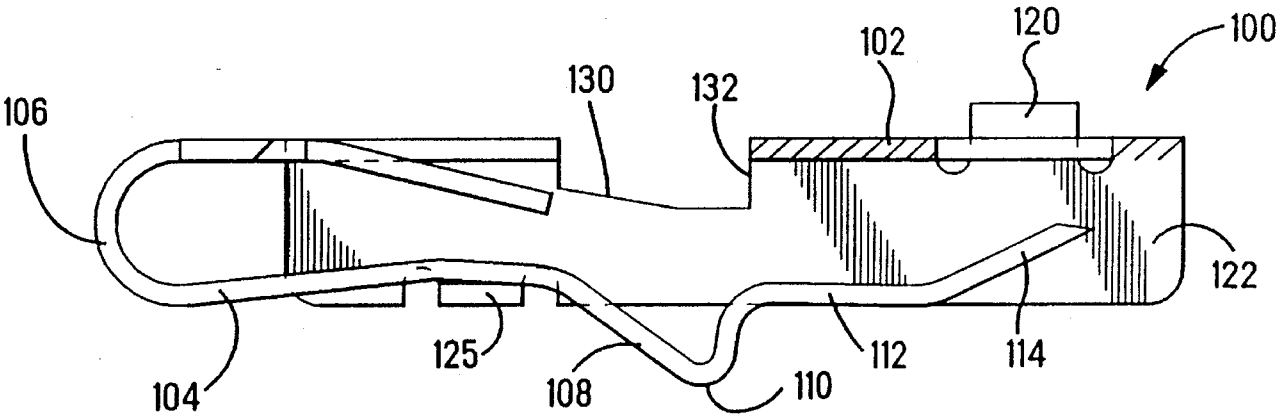
FIG. 9 is a cross sectional view taken through lines 9—9 of FIG. 7.
Figure 8:
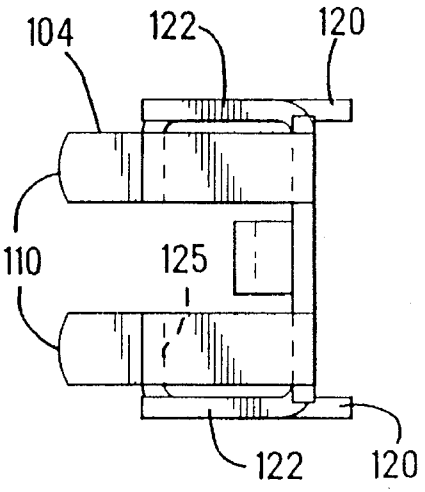
FIG. 8 is a front plan view of the shunt spring shown in FIG. 7.
Figure 7:
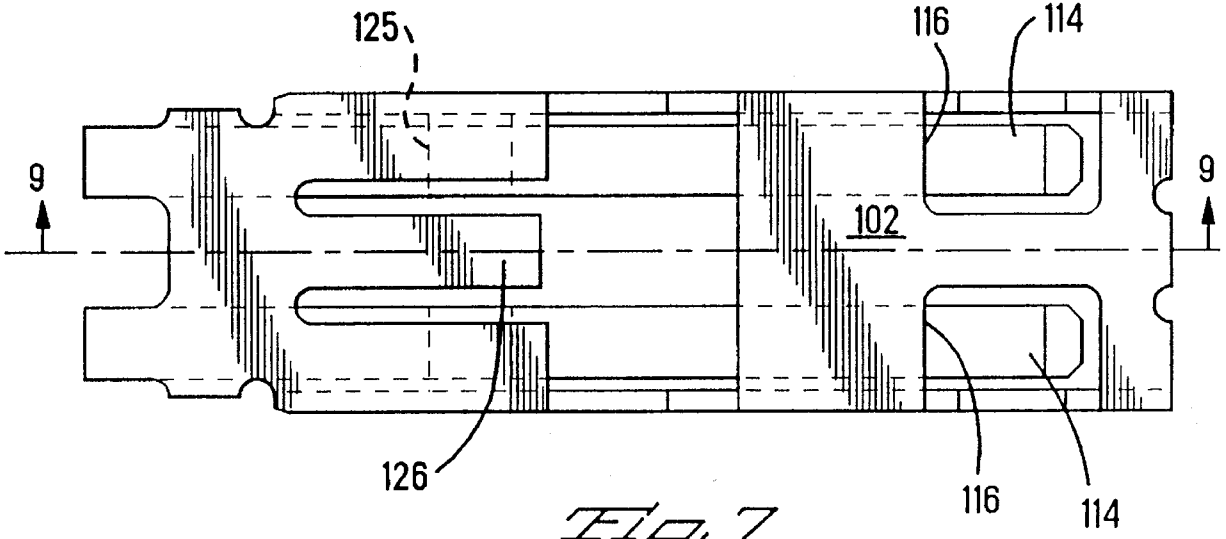
FIG. 7 is a lower plan view of the shunt spring which is usable in the present invention.

With respect now to FIGS. 7 through 9, a shunt spring is shown at 100 including a base wall 102 having two reversely bent cantilever springs at 104 bent around a U-shaped bight portion 106. The cantilever spring beams 104 extend rearwardly and have a projection at 108 thereby forming a contact surface at 110. The projection 108 is then lowered to a portion 112, and thereafter the free end 114 of the spring arm 104 extends obliquely towards the base portion 102. As shown best in FIGS. 7 and 9, windows 116 are stamped out of the base portion 102 which expose the free ends 114 of the cantilever springs 104, from the side facing the lower base portion 102, as best viewed in FIG. 7. After stamping the windows 116, a tab portion 120 is retained, and side walls 122 are bent upwardly providing the tab portions 120 in a common plane with the side walls 122. As best shown in FIG. 8, two such side walls are formed to provide rigidity and protection for the cantilever spring beams 104.

To provide a preload on the shunt cantilever beams 104, the spring arms are reversely bent from the plane forming the base portion 102 around the bight portion 106 and thereafter, tabs 125 are bent over the cantilever beams to preload the cantilever spring arms 104 against a lower surface of the tabs 125 as best shown in FIG. 9. As best shown in FIG. 7, a locking lance 126 is stamped out of the base portion 102 along the axial center line of the base portion and is bent inwardly towards the cantilever spring arm as best shown in FIG. 9. Finally an opening at 130 is stamped out of the shunt spring base wall 102 and side walls 122 thereby forming a locking edge surface 132 as will be described in greater detail herein.

To assemble the connector described above, the terminals 54 are first inserted into the respective terminal receiving passageways 52 through the rear wall 51 (FIG. 4) with the IDC slot 56 below the flanges 74 to a position where the locking lances 64 snap behind the locking shoulder 62 providing a primary lock for the electrical terminals 54. As shown best in FIG. 6, when in this primary locked position, the rear shoulder 66 is positioned adjacent to the surface of the window 68 for secondary locking purposes of the terminal as will be described herein. The electrical terminal contact 54 is shown in its fully received position in FIG. 10. As also shown in FIG. 10, the shunt spring 100 is poised for receipt within the passageway 80. It should be noted that the shunt spring 100 is being positioned through the front face 42 of the inner housing 40 with the bight portion 106 leading the contact. The shunt springs 100 are positioned within the passageways 80 such that the U-shape formed by the base wall 102 and the side walls 122 form an inverted U as best shown in FIG. 5. This positions the base wall 102 above the middle wall 84 and each of the cantilever spring beam arms 104 in there respective passageways 82.

Figure 11:
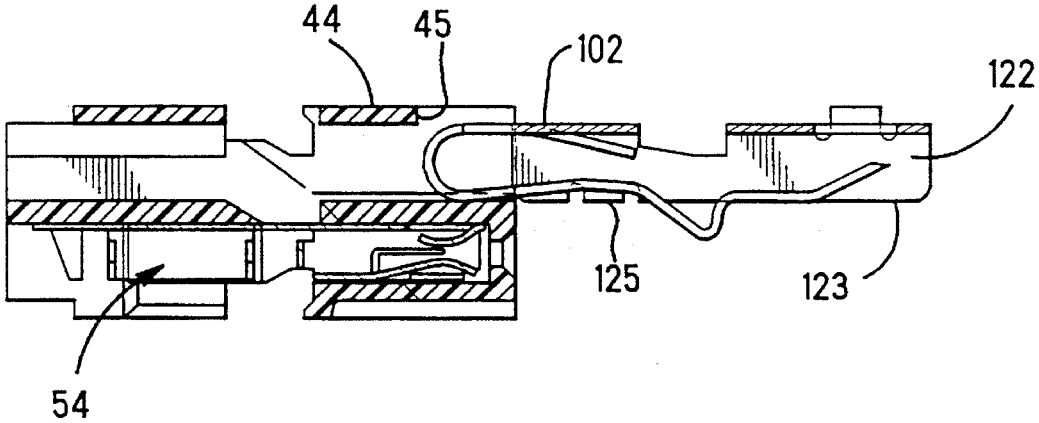
Figure 12:
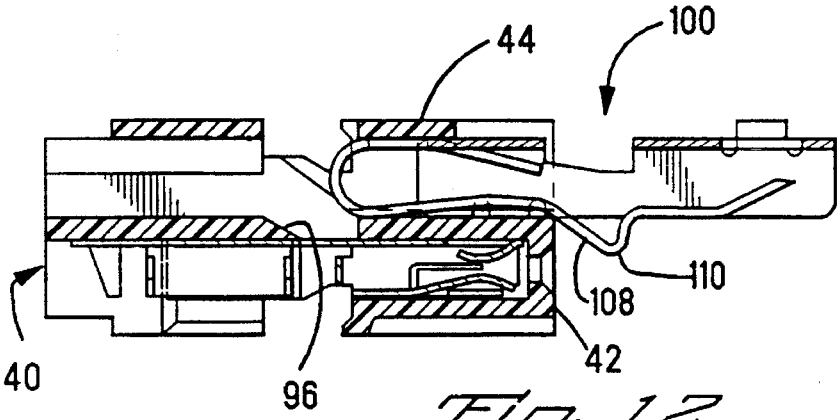

As shown in FIG. 11 the position of the shunt spring 100 within the cavity 80 is easily achieved as the shunt spring 100, and more particularly the cantilever spring arm beams 104 are held at a prestressed condition by the tabs 125. As shown in FIG. 12, the base wall 102 is now positioned beneath the side wall 44 of the housing 44 and the insertion of the shunt spring is being assisted by the guidance of the base wall 102 together with the lower edges of the side walls 122. It should also be noted that, as viewed in FIG. 11, the tabs 125, which hold these cantilever beams 104 in a prestressed condition, are positioned along the same line as the lower edge 123 of the side walls 122 thereby preventing stubbing of the tab portion 125 during the insertion of the shunt contact 100.

Figure 13:
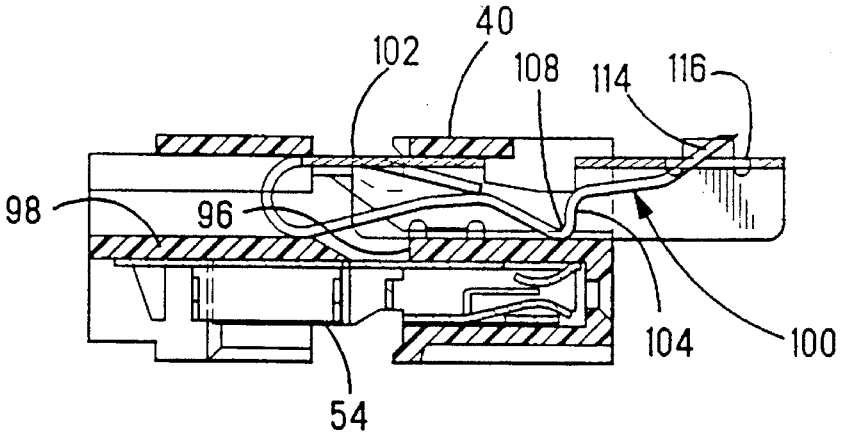
Figure 14:
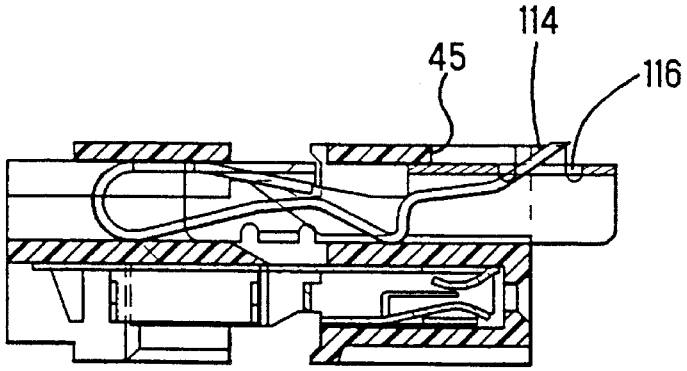

As shown in FIG. 12, when the shunt spring is inserted to the position that the projection 108 reaches the front face 42 of the housing 40, the shape of the projection 108 cams the cantilever spring arm inwardly such that the contact surface 110 is now within the cavity as shown in the progressive step of FIG. 13. Advantageously, the base wall 102 of the shunt spring has two windows at 116 which allow passage therethrough of the free ends 114 of the cantilever spring beams. This allows for easy flexing of the cantilever spring beam arm, and without over stressing the free end 114. With reference again to FIG. 4, it should be appreciated that a window 49 is positioned above the passageways 82 forward of the forwardly facing edge 45 of the housing side wall 44. This opening 49, as viewed in FIG. 14, allows the free end 114 of the shunt spring to continue forward while still extending through the window 116 through the base wall 102.

Figure 15:
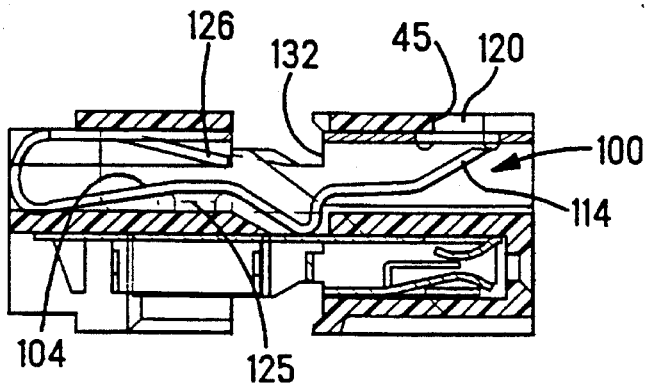

The shunt spring 100 is in its fully forward position when the tab 120 abuts the forwardly facing surface 45 of the housing. In this position, the contact portion 110 of the shunt spring is now aligned with the window 96 which allows the shunt projection 108 to resiliently deflect against the contact 54. It should also be appreciated that in this position, the locking lance 126 is locked against the shoulder 92 (FIG. 10) to retain the shunt spring in its fully locked position. It should also be appreciated that the shoulder 132 (FIG. 9 and 15) of the shunt spring 100 is positioned against the surface forming the window 88 (FIG. 6) which will assist in secondarily locking the shunt spring in position. It should also be noted that when in this position, that the cantilever beam portion 104 of the shunt spring is somewhat lifted off of the tab member 125 indicating that the contact portion 110 is resiliently biased against the contact member 52 in the terminal passageway directly therebeneath. This also somewhat deflects the free end 114 of the shunt spring 100 upwardly, as best viewed in FIG. 15, such that the free end 114 extends obliquely across the front face 42 of the housing 40.

The insulated conductors of a cable to be terminated to the terminals 54, can now be positioned above the respective insulation displacement portions 56 and be terminated through the windows 72 (FIG. 4) to the respective terminals 54. The inner housing 40, is now longitudinally slidable into the opening 16 from the left to the right as viewed in FIG. 1 such that the longitudinal rails 28 along the side walls 18 of the housing 4 are received within respective longitudinal openings 68 and 88. This positions the longitudinal rails 28 against the edge 66, of the terminals 54, and against the edge 132 (FIGS. 9 and 15) of the shunt springs 100. When the inner housing 40 is fully received within the outer housing shell 4, an end cap (not shown) is slidably received over the ribs 27 (FIG. 1) in a direction transverse to the front mating face, and is snapped in place to retain the inner housing 40.

With the fully assembled receptacle connector comprised of the outer housing 4 and the inner housing 40, it should be appreciated that the assembled connector can now be interconnected to a tab header of the type generally described in the aforementioned utility model, such that rotation of the pivot arm 6 brings the fully assembled connector into mating engagement with the tab header. It should also be appreciated that the tab header would include insulating tabs located proximate to the various openings 32 (FIG. 3) for making contact with the obliquely extending free end 114 of the shunt spring 100, which, when in the fully mated condition with the tab header, removes the respective cantilever beams 104 from shunting contact with the two adjacent terminals 54.

We claim:

1. An electrically shunted connector for mating with a complementary connector component having complementary terminals therein, where the electrically shunted connector comprises a connector housing having a row of terminal receiving passageways, where at least two of said passageways carry signal carrying contacts, said housing further comprising a shunting terminal passageway opposed to the at least two of said terminal receiving passageways of the row that have the signal carrying contacts therein and carrying a shunting terminal for commoning the two signal carrying contacts in the opposing row, the connector being characterized in that the shunt terminal passageway in the housing is profiled for front loading of said shunt terminal therein, and in that said housing and shunt terminal have relief areas to prevent overstressing said shunt terminal upon insertion therein.

2. The connector of claim 1, characterized in that said shunt terminals are comprised of a base portion having a reversely bent leg portion, where a contact section is formed on said reversely bent leg at a projection.

3. The connector of claim 2, characterized in that a lead-in section extends forwardly towards said front face of said housing and obliquely thereacross.

4. The connector of claim 3, characterized in that said shunt terminal comprise a base wall, folded-up side walls and two shunt contacts extending forwardly from a front edge of said base wall.

5. The connector of claim 4, characterized in that said relief area in said shunt terminal is formed by an opening opposing said lead-in sections, allowing said lead-in sections to pass therethrough.

6. The connector of claim 5, characterized in that tab portions extend from edge of said walls and are folded over the shunt contact arms to hold them in a prestressed condition.

7.The connector of claim 6, characterized in that a transverse opening is formed through the base wall forming a locking edge.

8. The connector of anyone of claims 1–7, characterized in that said housing relief area is comprised of a transverse opening spanning said shunt terminal receiving passageway.

9. The connector of claim 8, characterized in that the shunt terminal receiving cavities include a window communicating to corresponding signal carrying terminal cavities.

10. The connector of claim 7, characterized in that said housing has a transverse opening axially aligned with the opening and is slidably receivable into an outer housing shell having a locking arm receivable in said opening of said housing and into said opening of shunt terminals.

11. The connector of claim 1, characterized in that a second row of terminal receiving passageways is included in the housing and the shunting terminal passageway is disposed along the second row of terminal receiving passageways.

12. The connector of claim 11, characterized in that the row of terminal receiving passageways includes two additional passageways having signal carrying contacts therein and the second row of terminal receiving passageways includes another shunting terminal passageway opposite the two additional passageways with a shunting terminal therein.

13. The connector of claim 12, characterized in that the second row of terminal receiving cavities includes both shunting terminals and signal and signal carrying terminals with respective cavities.

14. The connector of claim 13, characterized in that the row of terminal receiving cavities are all for receiving signal carrying terminals therein.

* * * * *